US006938344B2

(12) United States Patent
Zuidervaart et al.

(10) Patent No.: US 6,938,344 B2
(45) Date of Patent: Sep. 6, 2005

(54) AUXILIARY PART FOR AN ELECTRIC SHAVER

(75) Inventors: Jasper Zuidervaart, Drachten (NL); Albert Jan Aitink, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/024,769

(22) Filed: Dec. 20, 2001

(65) Prior Publication Data

US 2002/0092173 A1 Jul. 18, 2002

(30) Foreign Application Priority Data

Dec. 22, 2000 (EP) ..... 00204809

(51) Int. Cl.[7] ..... B26B 19/38
(52) U.S. Cl. ..... 30/34.2; 30/537
(58) Field of Search ..... 30/41, 34.2, 43.6, 30/346.51, 34.05, 41.7, 537, 538; 424/73; D28/44, 50

(56) References Cited

U.S. PATENT DOCUMENTS 2,246,459 A 6/1941 Bahr
3,107,423 A * 10/1963 Caesar ..... 30/537
3,143,796 A * 8/1964 Bond ..... 30/34.05
3,477,127 A * 11/1969 Regan ..... 30/41
3,656,234 A * 4/1972 Regan ..... 30/537
4,003,390 A 1/1977 Solie ..... 132/45 R
4,417,397 A * 11/1983 Kitamura ..... 30/34.2
4,888,870 A * 12/1989 Fujikawa et al. ..... 30/233.5
4,899,442 A * 2/1990 Horii et al. ..... 30/41
5,283,953 A * 2/1994 Ikuta et al. ..... 30/43.6
5,388,331 A * 2/1995 Doroodian-Shoja Siamak ..... 30/41.7
5,603,161 A * 2/1997 Welsh ..... 30/346.52
5,621,971 A * 4/1997 Szymansky ..... 30/34.2
5,625,950 A * 5/1997 Sterk et al. ..... 30/43.6
5,706,582 A * 1/1998 Hosokawa et al. ..... 30/34.2
6,145,200 A * 11/2000 Jorna et al. ..... 30/43.6
6,317,983 B1 * 11/2001 Kakimoto ..... 30/43.6
2001/0027608 A1 * 10/2001 Barish ..... 30/34.2

* cited by examiner

*Primary Examiner*—Stephen Choi

(57) ABSTRACT

An auxiliary part (7) for an electric shaver, for mounting and removing accessories such as a skin-stretcher (9), a lubricator (14), etc. on and from the outer cutting member (4) of the shaver. To provide a cheap and simple part for mounting and removing accessories around and/or on a shaving head in a simple and quick manner, the auxiliary part is formed by an element (8) which at one side can be connected by snapping onto the outer cutting member (4) and at its other side has a device or structure for removably fastening one or more accessories (9, 14).

5 Claims, 4 Drawing Sheets

AUXILIARY PART FOR AN ELECTRIC SHAVER

BACKGROUND OF THE INVENTION

The invention relates to an auxiliary part for mounting shaving attachments such as a skin stretcher, a lubricator, and the like on or around an outer cutting member of an electric shaver in a detachable manner.

Electric shavers provided with attachments such as a skin stretcher and a lubricator, which are provided around or against the shaving head, respectively, are known per se. An electric shaver provided with rotary cutting members is known from U.S. Pat. No. 2,246,459 with a skin stretcher member provided around the outer cutting member of the shaving head. Furthermore, European patent document EP 0 773 855 discloses a manual shaver provided with a lubricant strip provided thereon which applies a certain amount of lubricant to the skin during shaving, with the result that shaving is performed more smoothly.

Such attachments are subject to pollution and wear during use. The former will occur mainly with the skin stretcher member, especially in electric shavers which are used for dry as well as wet shaving. Although rinsing under a tap suffices for normal cleaning, a more thorough cleaning will be desirable from time to time, for which the skin stretcher member will have to be detached from the shaving head. The lubricant carrier will supply the lubricant in the course of its operation and will be exhausted after some time, whereupon replacement is necessary.

BRIEF SUMMARY OF THE INVENTION

The invention has for its object to provide an auxiliary part which is of an inexpensive and simple construction and by means of which shaving attachments can be provided on or around a shaving head in a simple and fast manner and can be removed therefrom again.

To achieve this object, the auxiliary part according to the invention is characterized in that it is formed by an element which can be clicked onto the corresponding outer cutting member by its one side and is provided at its other side with fastening means, for example snap connection means, for one or several shaving attachments.

All attachments present can be mounted to the shaving head simultaneously by means of said element in this manner, and can be removed again, if so desired, also simultaneously. This leads to a considerably enhanced ease of use. The element may here be used on the shaving head of shavers of both the rotary and the oscillatory type.

In an embodiment of the auxiliary part suitable for a shaver whose outer cutting member is formed by a shaving foil, the auxiliary part has a rectangular shape with one or two rectangular recesses, each of which narrowly fits the outer circumference of the cutting member(s), and said auxiliary part is provided at its upper side along the long sides of the respective recesses with means for fastening at least one skin stretcher member and at least one lubricant carrier. The inner cutting member in such a shaver may then be formed by an oscillatory reciprocating shaving element or by a rotating cylindrical shaving element.

In a further embodiment suitable for a shaver with a rotary cutting member, the annular element is provided at its inner circumference with a cylindrical surface which narrowly fits around the outer circumference of the cutting member, and is also provided with a cylindrical surface at its outer circumference, over which surface an annular skin stretcher member or lubricant member is provided with narrow fit.

From the above and following descriptions and the drawing, it will be clear to those of ordinary skill in the art that such an outer cutting member has a multiplicity of hair inlet openings extending from an outer surface of the outer cutting member to an inner surface. The hair inlet openings are arranged such that hairs to be shaved will extend through respective openings. At least one inner cutting member moves along the inner surface of the outer cutting member past these openings, and the hairs are then cut by cooperation of the inner cutting member with the outer cutting member.

In a further embodiment, a surface with a raised, slightly conical edge is provided within the ring so as to be connected to the ring, on which edge a lubricant carrier can be provided.

For fastening the auxiliary part with the shaving attachments provided thereon securely on the outer cutting member, the central surface is provided at its other side with a projection which fits an accommodation space of the cutting member. The auxiliary part in this manner is not only in contact with the outside of the cutting member, but also with the central cavity present in the cutting member.

To make it clear to a user of the electric shaver when the lubricant carrier is due for replacement, a wear indicator is provided below the lubricant carrier, which becomes visible when the lubricant carrier has become substantially exhausted and is due for replacement. This indicator may be a legend or a colored spot.

The invention further relates to an electric shaver whose shaving head is provided with an auxiliary part as described above.

BRIEF DESCRIPTION OF THE SEVERAL VIEWS OF THE DRAWING

The invention will be explained in more detail below with reference to the drawing in which an embodiment of an auxiliary part with attachments for an electric shaver is shown by way of example.

DETAILED DESCRIPTION OF THE INVENTION

Figure 1:
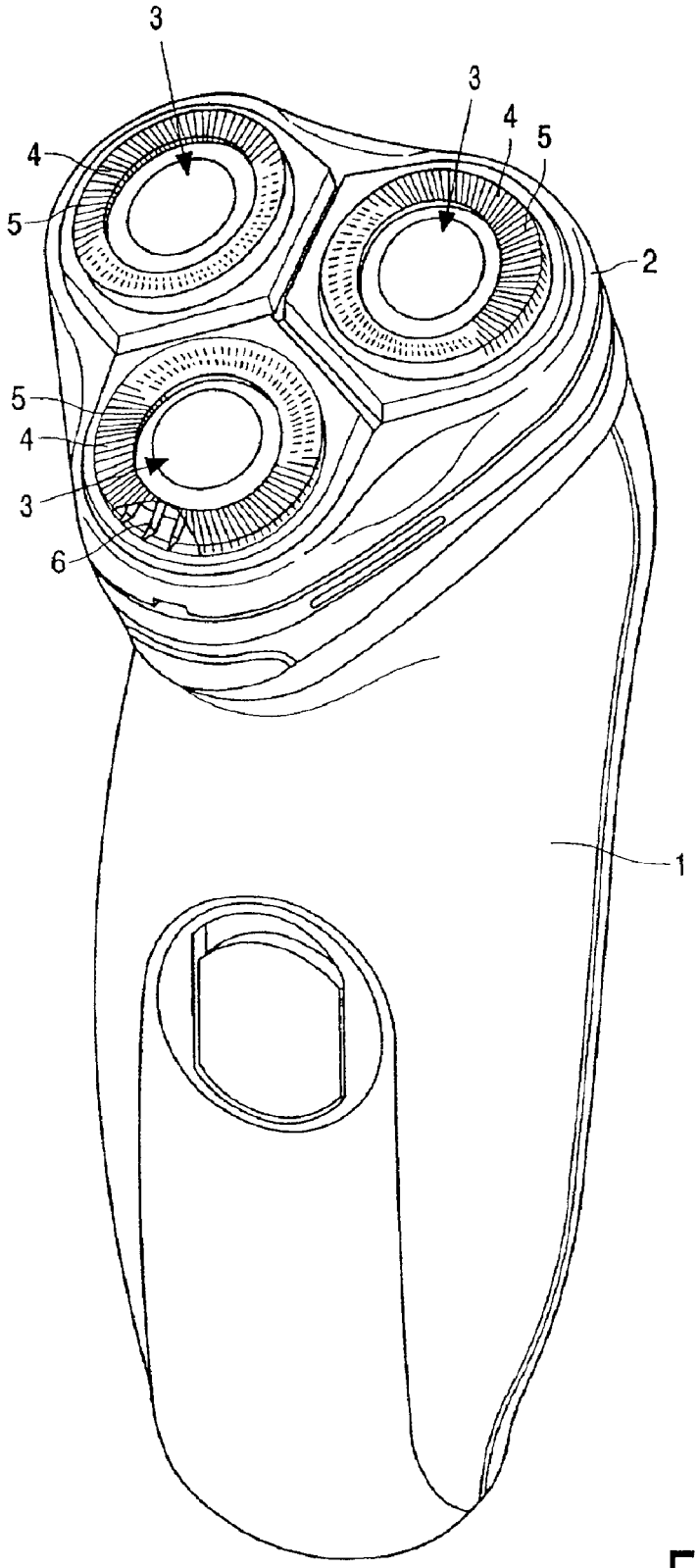
FIG. 1 diagrammatically and not true to scale shows an electric shaver with rotary cutting members in perspective view.

The electric shaver shown in FIG. 1 is provided with a housing 1 with a shaving head holder 2 which can be removed from the housing or which is hinged to the housing. Three shaving heads 3 are accommodated in the shaving head holder 2, each having an outer hair cutting member 4 with hair inlet openings 5 and an inner hair cutting member 6, which latter member is capable of being driven into rotation with respect to the outer cutting member. The inner hair cutting members are driven by a motor (not shown) which is accommodated in the housing of the shaver.

Figure 2:
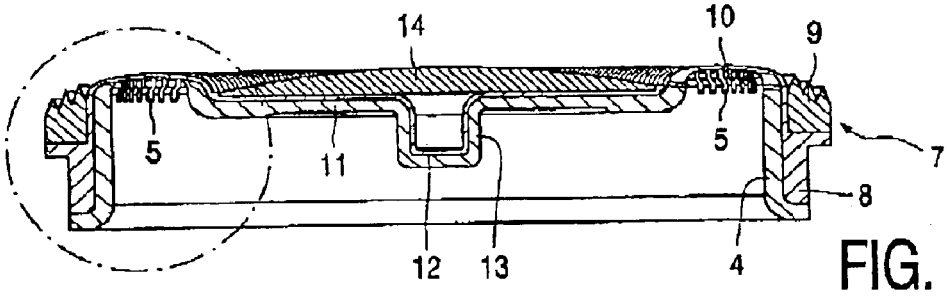
FIG. 2 shows the auxiliary part with attachments in a diagrammatic cross-sectional view not true to scale.

FIG. 2 shows a cross-section of an outer cutting member 4. An auxiliary part 7 with attachments is snapped home onto the outer cutting member 4. The auxiliary part 7 consists of an annular element 8 which has an inner diameter such that it narrowly fits around the cutting member 4. A skin stretcher member 9 is provided on the annular element 8. The annular element 8 is connected to a central surface 11 via a few connecting portions 10, which surface lies somewhat depressed in the central portion of the cutting member 4 and is provided with a projection 12 at its lower side, which projection is accommodated in a cavity 13 in the cutting member 4.

The annular element 8 is very securely fastened to the outer cutting member 4 in this manner. A disc 14 of a material comprising a lubricant is provided on the central surface 11. The shaving attachments 9 and 14 are thus mounted to the outer cutting member 4 by means of a carrier element 8 and can be removed again from the cutting member 4 simultaneously with the annular carrier 8 when either the skin stretcher member 9 is polluted or the lubricant carrier 14 is exhausted.

Figure 3:
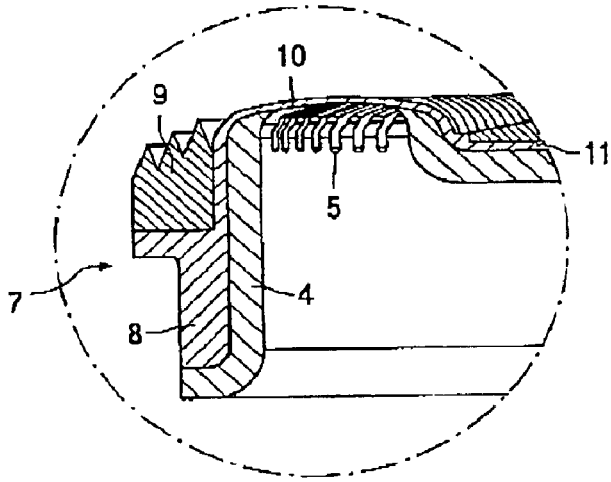
FIG. 3 shows part of the auxiliary part of FIG. 2 on an enlarged scale.
Figure 4:
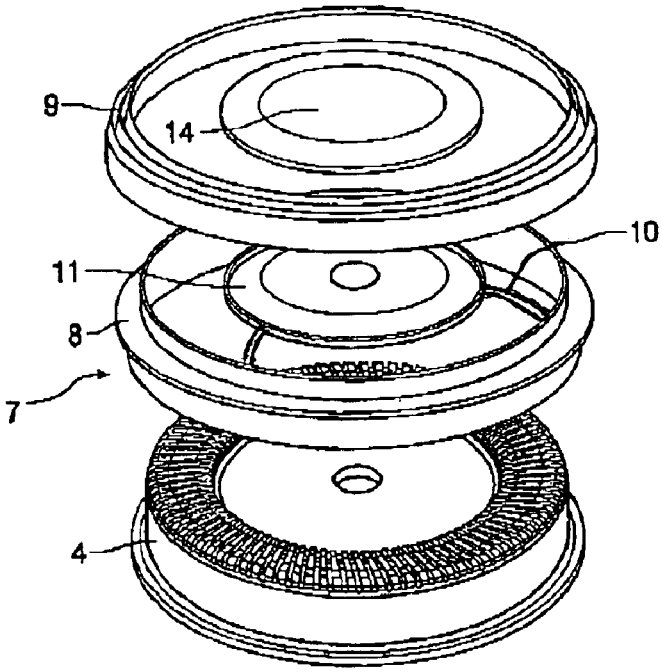
FIG. 4 shows a combination of an outer cutting member with auxiliary part and attachments in an exploded view.

To clarify the construction of the auxiliary part 7 and the manner in which it is provided on the cutting member 4, FIG. 3 shows a detail from FIG. 2 on an enlarged scale, while the parts are depicted in perspective view in FIG. 4.

To render it recognizable to the user that the lubricant carrier 14 has been almost used up, the central surface 11 below the lubricant disc 14 is provided with a legend or a colored spot which indicates that the lubricant disc is due for replacement. At that moment the lubricant disc may be removed from the cutting member together with the skin stretcher member by means of the annular element 8 and be replaced with a new disc.

Figure 5:
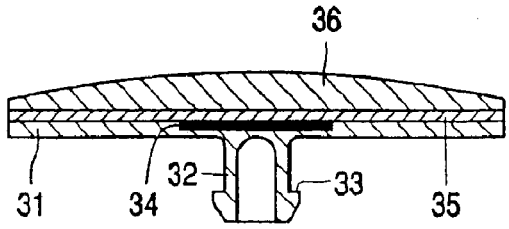
FIG. 5 shows an alternative embodiment of an auxiliary part according to the invention in a diagrammatic cross-sectional view.

FIG. 5 shows an auxiliary part in cross-section for fastening a lubricant carrier on an outer cutting member of a rotary shaver. Reference numeral 31 here denotes a base part which is provided at its one side with a projection 32 which is somewhat resilient owing to axial incisions (not shown) so that it can cooperate with a cavity in the outer cutting member. The edge 33 can then grip behind a mating rim (not shown) in the cavity so that a snap connection is created. A wear indicator 34 is provided on the base part 31, as well as a layer 35 by means of which a lubricant carrier 36 is fastened to the base part. A lubricant carrier for an electric shaver is obtained in this manner which is easy to mount and to exchange.

Figure 6:
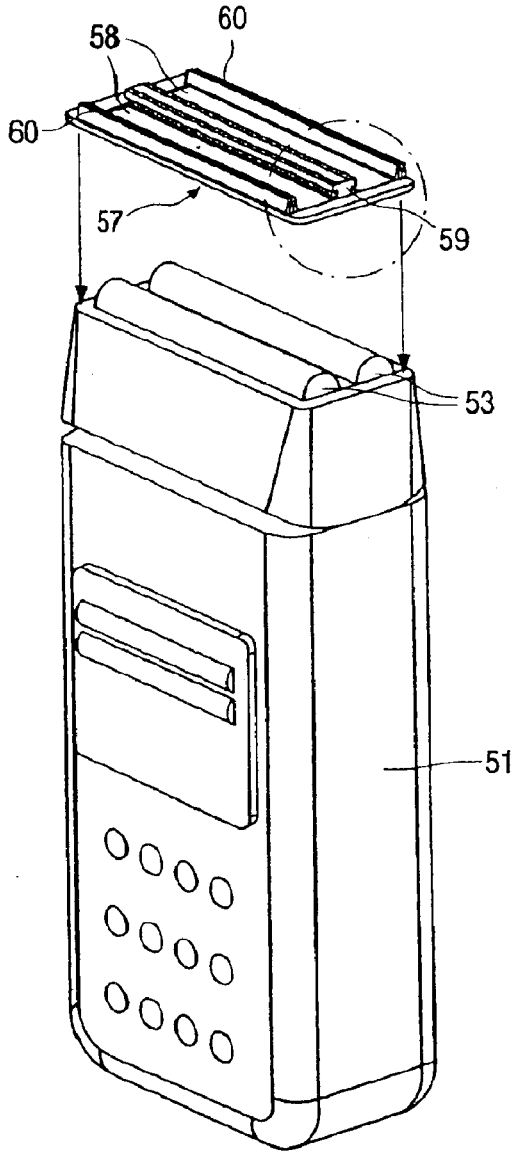
FIG. 6 is a diagrammatic perspective view not true to scale of an electric shaver with a shaving foil and, shown above it, an auxiliary part which can be placed thereon.

FIG. 6 diagrammatically and in perspective view shows an electric shaver with a housing 51 and outer cutting members 53 in the form of shaving foils. A frame 57, for example made of synthetic resin, is shown above the cutting members 53 and is provided with elongate recesses 58 with a shape which narrowly fits around the two cutting members 53. The frame is provided at its upper side along the longer sides of said recesses 58 with means (not shown) by which a lubricant carrier 59 and two skin stretcher members 60 can be mounted to the upper side of the frame 57.

Figure 7:
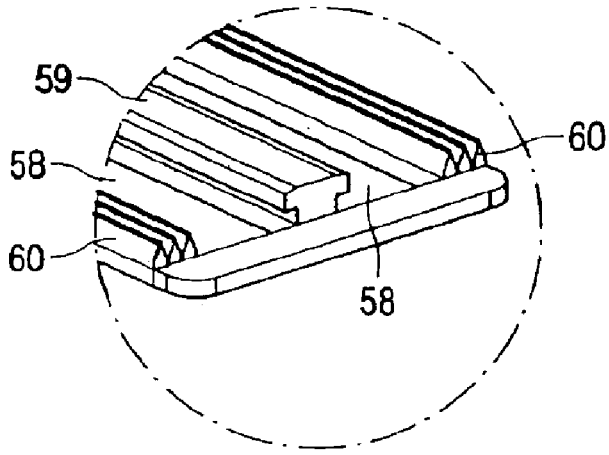
FIGS. 7 and 8 are enlargements of details of the auxiliary part which can be mounted in FIG. 6.

FIG. 7 shows part of the frame 57 on an enlarged scale.

Figure 8:
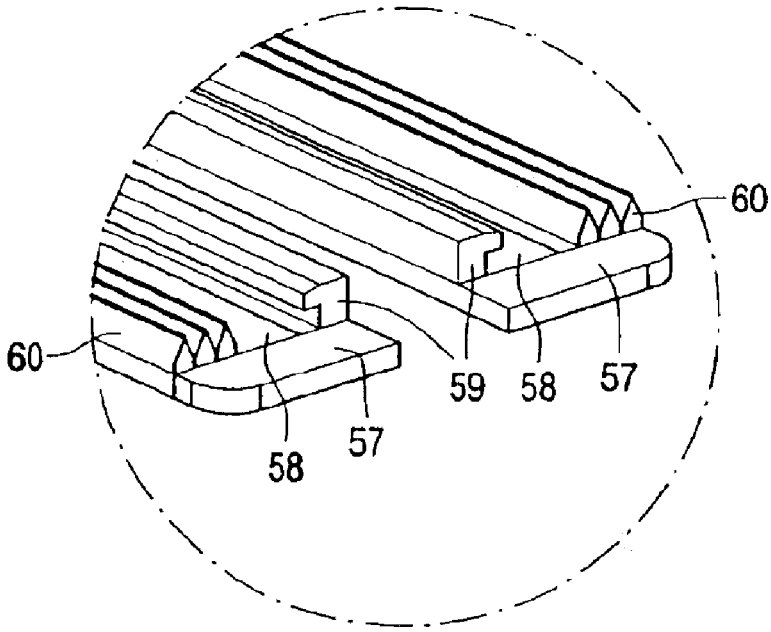

Although the frame 57 is depicted as an integral whole for the two cutting members 53 in the embodiment of FIGS. 6 and 7, it is alternatively possible to construct the frame 57 in two parts as shown in FIG. 8.

The foregoing descriptions make clear that in each of the embodiments disclosed the auxiliary part functions only to support and position attachments used in shaving.

It should be noted that the frame 57 may be fastened on the housing 51 of the shaver, but it is alternatively possible to fasten the frame 57 of an adapted shape to the shaving foil 53 such that it forms as it were an integral whole therewith.

What is claimed is:

1. An auxiliary part for mounting shaving attachments to an outer cutting member of an electric shaver in a detachable manner, wherein said outer cutting member has a multiplicity of hair inlet openings extending from an outer surface of the outer cutting member to an inner surface, and wherein the hair inlet openings are arranged such, during shaving, hairs to be shaved extend through respective openings, characterized in that the auxiliary part is formed by an element which can be snapped onto the corresponding outer cutting member by its one side and is provided at its other side with means for removably fastening at least one shaving attachment to the element, characterized in that the auxiliary part has a rectangular shape with at least one rectangular recess which narrowly fits the outer circumference of the cutting member(s), and said auxiliary part is provided at its upper side along the long sides of the recess with said means for removably fastening at least one shaving attachment, said shaving attachment is a lubricant carrier, the auxiliary part has two said rectangular recesses, one on each side of a central portion, and a wear indicator is provided on an outer surface of the central portion, the wear indicator becoming visible when the lubricant carrier has become substantially exhausted and is due for replacement.

2. An auxiliary part for mounting shaving attachments in a detachable manner onto one rotary cutting member of an electric shaver provided with several rotary cutting members, said rotary cutting members each having a respective outer cutting member, characterized in that:

the auxiliary part is formed by an element which can be snapped onto the respective outer cutting member of said one rotary cutting member by its one side and is provided at its other side with means for removably fastening at least one shaving attachment to the element, and the element is formed by a base part provided at one side with a projection which can be fastened in a central cavity of said respective outer cutting member by means of a snap connection, and a wear indicator covered by a lubricant layer is provided on the other side of the base part.

3. An auxiliary part for mounting shaving attachments in a detachable manner to an outer cutting member of an electric shaver provided with rotary cutting members each having a respective outer circumference, characterized in that:

the auxiliary part is formed by an element arranged for snapping onto the corresponding outer cutting member by its one side and is provided at its other side with means for removably fastening at least one shaving attachment to the element, said element includes an annular element which has an inner circumference and an outer circumference and is provided at said inner circumference with an inner cylindrical surface which narrowly fits around the outer circumference of the cutting member, and is also provided with an outer cylindrical surface at the element's outer circumference, and an annular shaving attachment is provided with narrow fit over said outer cylindrical surface, and the element further includes a central portion having an outer surface with a raised, slightly conical edge, the central portion being disposed within and connected to the annular element for removably fastening a lubricant carrier on the outer surface.

4. An auxiliary part as claimed in claim 3, characterized in that the central portion is provided at an inner side with a projection which fits within an accommodation space of the cutting member.

5. An auxiliary part as claimed in claim 3, characterized in that said shaving attachment provided with narrow fit over said outer cylindrical surface is a skin stretcher.

* * * * *